United States Patent [19]

Matayoshi et al.

[11] Patent Number: 5,038,732

[45] Date of Patent: Aug. 13, 1991

[54] INTERNAL COMBUSTION ENGINE CYLINDER HEAD

[75] Inventors: Yutaka Matayoshi, Yokosuka; Shigeru Kamegaya, Tokyo; Shigeo Muranaka, Yokosuka, all of Japan

[73] Assignee: Nissan Motor Co., Ltd., Yokohama, Japan

[21] Appl. No.: 575,895

[22] Filed: Aug. 31, 1990

[30] Foreign Application Priority Data

Sep. 5, 1989 [JP] Japan ..... 1-230063

[51] Int. Cl.[5] ..... F02F 1/00

[52] U.S. Cl. ..... 123/193 H; 123/90.4; 123/90.33

[58] Field of Search ..... 123/193 H, 90.27, 90.33, 123/90.4, 90.39, 90.38, 90.41, 90.43, 90.44, 90.46

[56] References Cited

U.S. PATENT DOCUMENTS

| | | | |
|---|---|---|---|
| 4,649,873 | 3/1987 | Amano | 123/90.33 |
| 4,754,729 | 7/1988 | Abe et al. | 123/193 H |
| 4,825,822 | 5/1989 | Muranaka et al. | 123/90.4 |
| 4,913,104 | 4/1990 | Mills | 123/90.4 |
| 4,951,622 | 8/1990 | Takahashi et al. | 123/193 H |

FOREIGN PATENT DOCUMENTS

| | | |
|---|---|---|
| 2342530 | 5/1974 | Fed. Rep. of Germany . |
| 1-22464 | 4/1989 | Japan . |
| 2179700 | 3/1987 | United Kingdom . |
| 2199372 | 7/1988 | United Kingdom . |

*Primary Examiner*—Andrew M. Dolinar
*Assistant Examiner*—M. Macy
*Attorney, Agent, or Firm*—Foley & Lardner

[57] ABSTRACT

A cylinder head of a DOHC internal combustion engine has intake and exhaust ports of a siamese shape. A pivot for a rocker arm of the end pivot type is installed in a pivot installation hole which is formed at a nearer point from each cylinder than the branched point of each of the intake and exhaust ports. With this arrangement, since the pivot installation hole can have a sufficient depth without deforming the shape of the intake port, each swinging end of the rocker arm for intake valves and that for the exhaust valves can be disposed opposite to each other. Therefore, the engine is improved with respect to its performances and size.

7 Claims, 3 Drawing Sheets

INTERNAL COMBUSTION ENGINE CYLINDER HEAD

BACKGROUND OF THE INVENTION

1. Field of the Invention

This invention relates to improvements in a cylinder head structure with which an engine is improved with respect to its performance and size.

2. Description of the Related Art

It is well known that an internal combustion engine uses a valve mechanism having double overhead camshafts (DOHC) which are provided to operate two intake valves and two exhaust valves for each cylinder of the engine. A cylinder head used for such a DOHC engine is disclosed, for example, in Japanese Patent Publication No. 1-22464. In this cylinder head, a rocker arm of the end pivot type is disposed between each of the camshafts and each of the intake and exhaust valves so that the intake and exhaust valves can be sufficiently lifted. Each pivot for supporting each rocker arm is disposed at a position which is nearer than where the camshaft is located relative to a cylinder axis, and is installed in a boss which is formed around a spark plug boss of each cylinder. Other configurations such as oil passages for supplying oil to the pivots are disposed on the central part of the cylinder head.

However, with this structure, since the length of the rocker arm enlarges an angle which is defined between an intake valve stem and an exhaust valve stem, the inclination of an upper surface of the pentroof type combustion chamber is increased. This causes a problem in that the ability to maintain a sufficient compression ratio becomes difficult. Additionally, since the distance between an intake valve camshaft and an exhaust valve camshaft is increased, the lateral width of the cylinder head becomes larger.

In order to overcome the above problems, it has been proposed that the rocker arms for the intake and exhaust valves be disposed in a manner such that the swinging end sections of the rocker arms of the intake and exhaust valves are opposite to each other. However, difficulties have been encountered with the above-proposed rocker arms configuration in that a sufficient depth of the pivot installation hole cannot be obtained or the shape of the intake and exhaust ports are largely restricted since this configuration demands that the pivot installation holes be disposed near the side periphery of the cylinder head and the openings of the intake and exhaust ports.

SUMMARY OF THE INVENTION

It is an object of the present invention to provide an improved cylinder head in which rocker arms for intake and exhaust valves can be disposed in a manner such that the swinging end sections of the rocker arms for the intake and exhaust valves are opposite to each other while a pivot installation hole has a sufficient depth.

Another object of the present invention is to provide an improved cylinder head for a high performance engine in which the intake and exhaust valves are sufficiently lifted and in which a high compression ratio is obtained while at the same time providing a small sized engine.

A cylinder head of an internal combustion engine comprises two engine valves provided for each cylinder of the engine. A rocker arm is in contact with the top ends of the engine valves at a first end of the rocker arm. A pivot is contact with a second end of the rocker arm so as to swingingly support the rocker arm. A gas port is formed in the cylinder head so that a gas passes through the gas port. The gas port has a first passage section which is opened to the outside of the cylinder head, and second and third passage sections which are connected with the first passage section and communicable with the cylinder. The second and third passage sections are separate from each other. A pivot installation hole is formed between the second and third passage sections of the gas port. The pivot installation hole receives the pivot therein.

With this structure, each swinging end of the rocker arm the intake valves and that of the exhaust valves can be disposed opposite to each other so that the axis of the intake valve stem and the axis of the exhaust valve stem can have a small angle therebetween. Thus, the upper surface of the pentroof type of combustion chamber becomes flatter so that the engine can have a high compression ratio while becoming smaller in size.

DETAILED DESCRIPTION OF THE PREFERRED EMBODIMENTS

Figure 1:
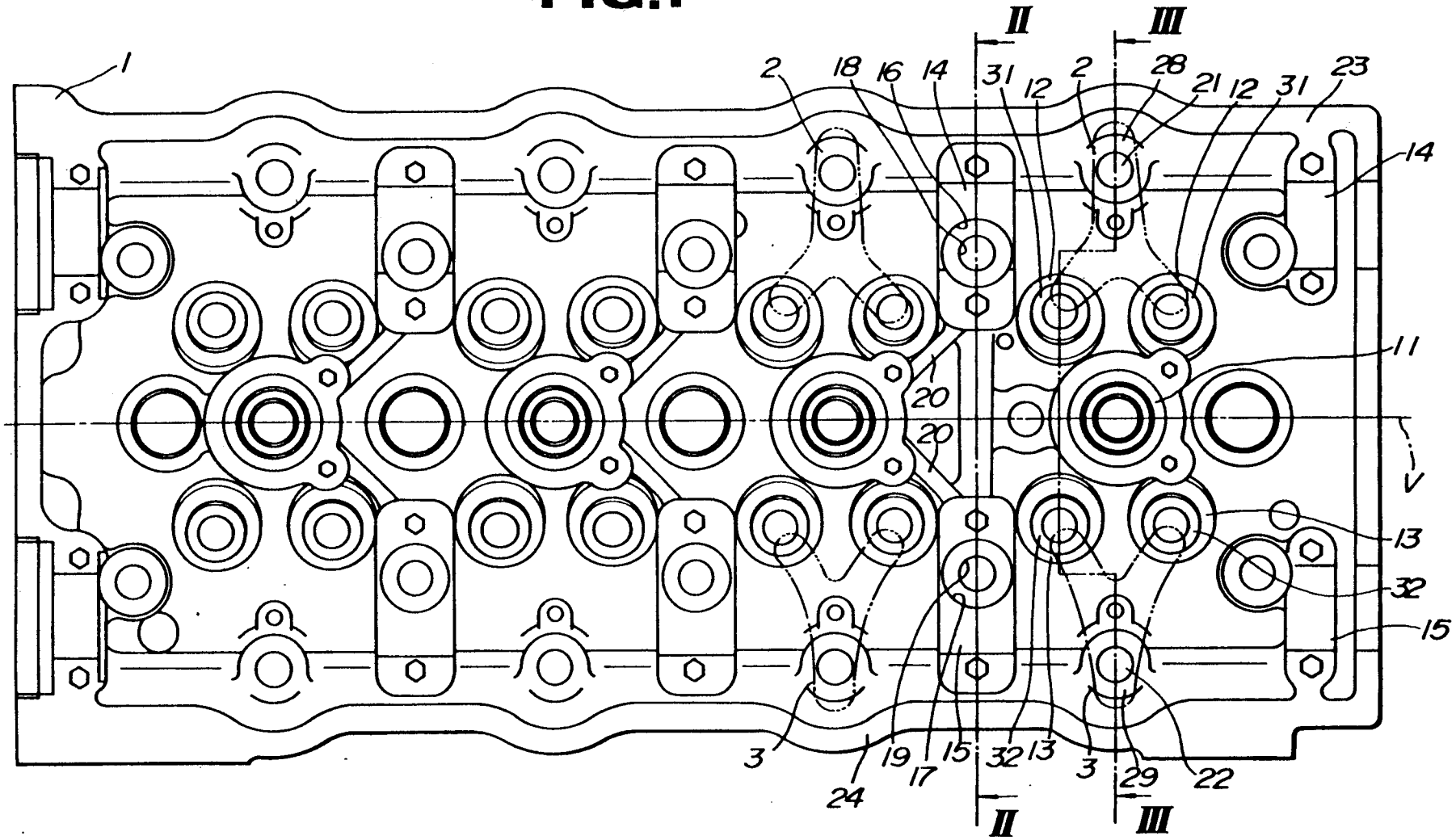
FIG. 1 is a plan view of an embodiment of a cylinder according to the present invention.

Referring now to FIG. 1, there is shown an embodiment of a cylinder head 1 according to the present invention. The cylinder head 1 forms part of a four cylinder internal combustion engine having double overhead camshafts (DOHC). Two intake valves (engine valves) 51 and two exhaust valves (engine valves) 52 are provided for each cylinder (not shown) of the engine. The cylinder head 1 has a spark plug boss 11 to be located on the central part of each of the cylinders. The intake and exhaust valves 51, 52 are slidably installed respectively to valve bosses 12, 13 which are so located as to surround the spark plug boss 11. Bearing sections 14, 15 are formed in the cylinder head 1 to be located respectively in the vicinity of each cylinder or in such positions as to surround each cylinder. The bearing sections 14 support an intake valve camshaft 44 which operates the intake valves 51. Similarly, the bearing sections 15 support an exhaust valve camshaft 45 which operates the exhaust valves 52. Each of the bearing sections 14, 15 and the spark plug boss 11 are interconnected with a rib 20 so that engine rigidity is improved.

Figure 2:
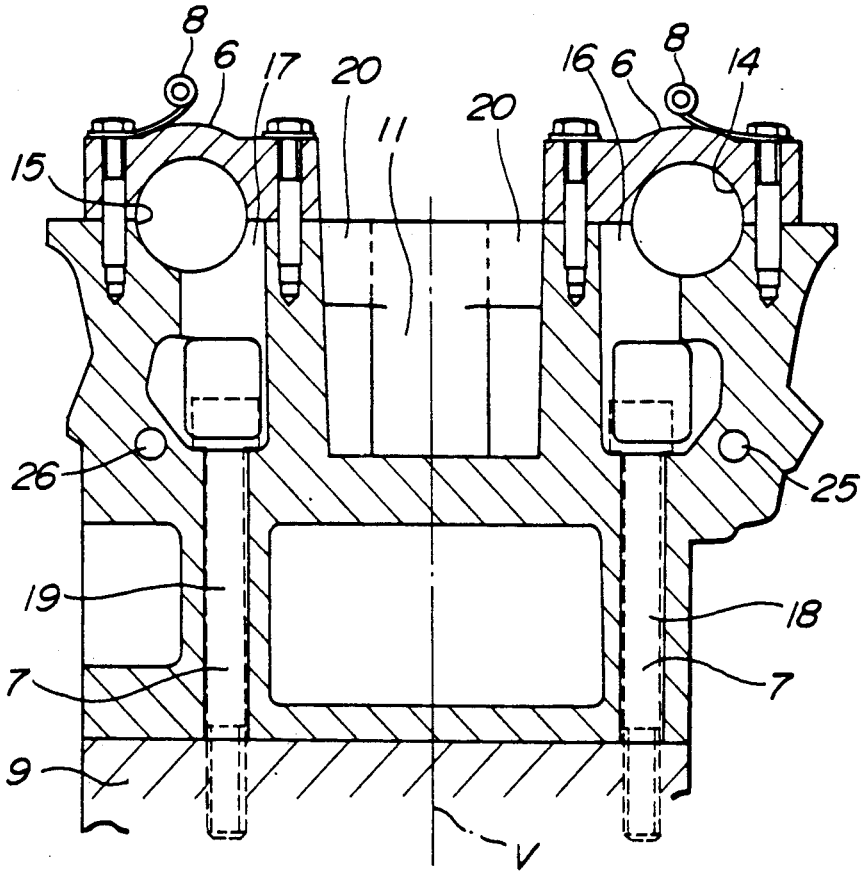
FIG. 2 is a side cross-sectional view of the cylinder head taken in the direction of arrows substantially along the line II—II of FIG. 1.

As shown in FIG. 2, each of the bearing sections 14, 15 has a head bolt insertion-hole 16, 17 which vertically extends through the bearing sections 14, 15. The head bolt insertion-hole 16, 17 is aligned and is in communication with a head bolt hole 18, 19 which vertically extends and is coaxial with the head bolt insertion-hole 16, 17, so that the aligned head bolt insertion-hole and head bolt hole pass through the cylinder head 1. Head bolts 7 for connecting the cylinder head 1 and a cylinder block 9 are installed in a state such that the head of the head bolt 7 is mounted on the shoulder formed between the head bolt hole 18, 19 and the head bolt insertion-hole 16, 17. The threaded section of the head bolt 7 is screwed into the cylinder block 9. With this arrangement, the head bolts 7 can be disposed between the cylinders at predetermined intervals to fixedly secure the cylinder head 1 on the cylinder block 9 through a gasket (not shown), so that a good seal is obtained between the cylinder block 9 and the cylinder head 1.

In order to operate the intake and exhaust valves 51, 52 in accordance with the rotation of the camshafts 44, 45, generally Y-shaped rocker arms 2, 3 are movably installed on the cylinder head 1. Thus, one end section of the rocker arm 2, 3 is bifurcated into two portions which are respectively brought into contact with the top ends (no numeral) of the intake and exhaust valves 51, 52. The other end of each rocker arm 2, 3 is pivotally supported by each pivot 41, 42 on the cylinder head 1.

Figure 3:
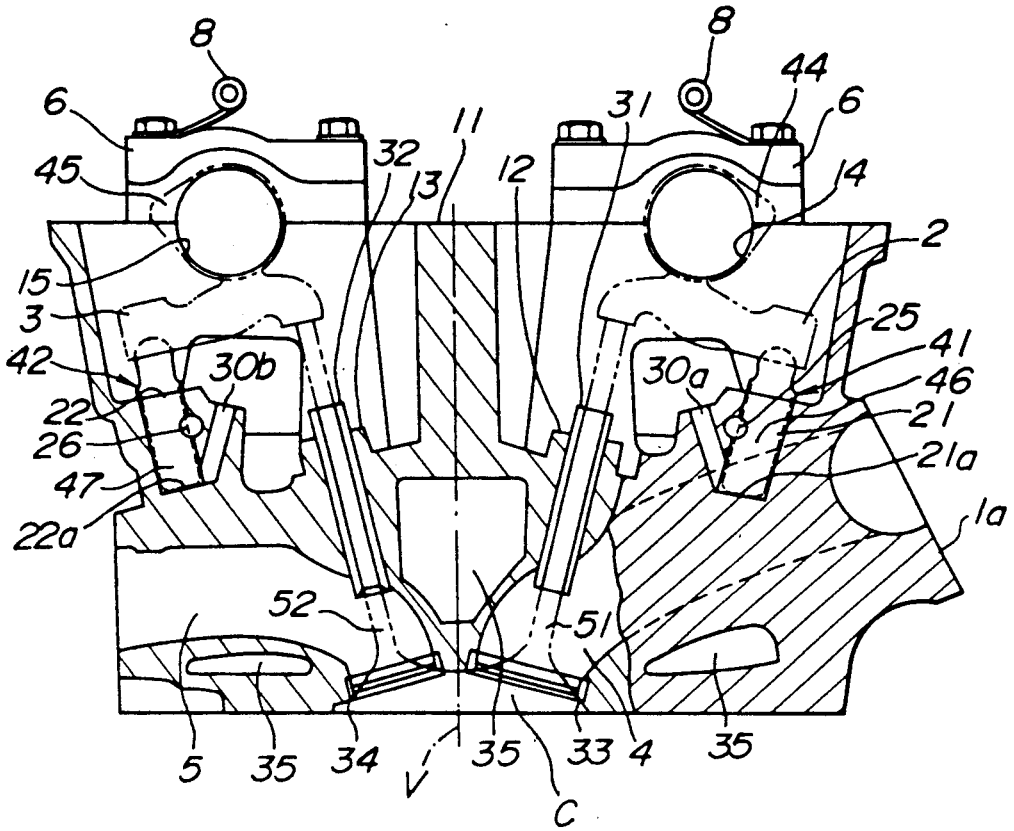
FIG. 3 is a side cross-sectional view of the cylinder head taken in the direction of arrows substantially along the line III—III of FIG. 1.

As shown in FIG. 3, the pivot 41, 42 is installed in a pivot installation hole 21, 22 which is formed in the boss section 28, 29. The boss section 28, 29 is disposed adjacent each side wall 23, 24 whose surface forms part of the peripheral surface of the cylinder head 1. The side walls 23, 24 are generally parallel with the axis of the camshaft 44, 45. There is shown an imaginary vertical plane V including an axis of the cylinder head in FIGS. 1, 2 and 3. The pivot 41, 42 is located outside of the camshaft 44, 45 relative to the vertical plane V.

Figure 4:
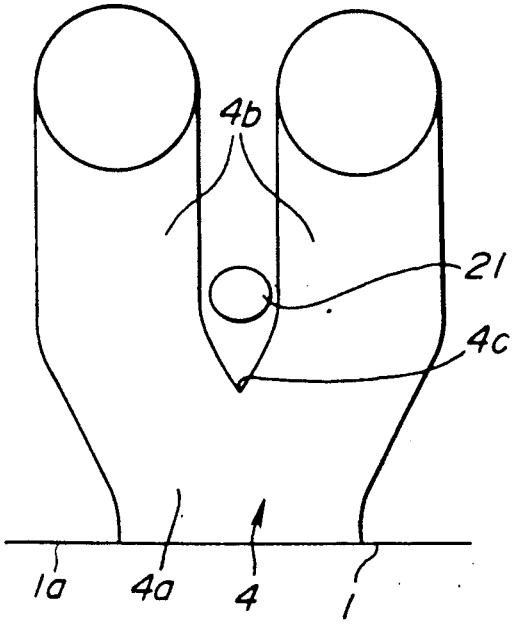
FIG. 4 is a plan view of an intake port and a pivot installation of the cylinder head of FIG. 1.

As shown in FIGS. 3 and 4, the cylinder head 1 is formed with an intake port 4 of a siamese shape. The intake port 4 has one passage 4*a* at its upstream side and is branched into two passages 4*b* which are communicable with each cylinder so that intake air is guided into each cylinder via the two passages of each intake port 4. The passage 4*a* opens at a side surface 1*a* of the cylinder head 1, while each passage 4*b* is communicable with a combustion chamber C forming part of the cylinder. The pivot installation hole 21 is formed between the two passages 4*b* of the intake port 4 at a predetermined depth. The bottom 21*a* of the pivot installation hole 21 is lower in level than the upper part of the inner surface of the intake port 4. A hydraulic lash adjuster 46, 47 is inserted in each pivot installation hole 21, 22 so that the pivot 41, 42 is supported by hydraulic power. The pivot installation holes 21, 22 are connected respectively with holes 30*a*, 30*b* through which remaining air is discharged when the lash adjuster 46, 47 is attached in each of the pivot installation holes 21, 22.

While the position of the pivot installation hole 21 has been shown and described in connection with the intake port 4, it will be understood that the pivot installation hole 22 in connection with the exhaust port 5 may be also located between the two branched passages of the exhaust port 5 at a predetermined depth so that the pivot installation hole 22 is lower in level that the upper part of the inner surface of the exhaust port 5.

Each tube-shaped valve guide 31, 32 is inserted into holes (no numeral) which are formed at the valve boss 12, 13. For the combustion chamber C of the pentroof type which is shown in FIG. 3, valve seats 33, 34 are provided respectively at the ends of the intake and exhaust ports 4, 5. Numeral 35 indicates water jackets through which cooling water flows to cool the engine.

A pair of generally straight oil passages 25, 26 are disposed in the cylinder head 1 to connect the pivot installation holes 21, 22. The hydraulic oil is supplied to each lash adjuster 46, 47 through the oil passage 25, 26 and lubricates a sliding surface of the pivot 41, 42. Each camshaft bracket 6 is fixedly secured on each of the bearing sections 14, 15 with two bolts to support each of the camshafts 44, 45. A pipe-shaped member 8, defining therein an oil passage, is disposed on the camshaft bracket 6 so that the lubricating oil is sprayed over the sliding surfaces of the camshafts 44, 45 and of the stems of the intake and exhaust valves 51, 52.

The manner of operation of the thus arranged cylinder head will be discussed hereinafter.

In an assembly operation of the engine, the head bolt 7 and a head bolt tightening tool are set over the head bolt hole 18, 19 in the head bolt insertion-hole 16, 17, which vertically passes through the cylinder head 1 and is formed through each bearing section 14, 15, before the cylinder head 1 and the cylinder block 9 are secured together with the head bolts 7.

In this operation, since the head bolt hole 18, 19 is formed to be located under the bearing section 14, 15, the head bolt 7 and the bearing section 14, 15 can be positioned in the vicinity of the cylinder.

Additionally, since the Y-shaped rocker arm is used in this arrangement with the above-mentioned structure, the boss 28, 29 for the pivot installation hole 21, 22 can be formed at a position far from-the spark plug boss 11 than the camshaft bearing sections 14, 15 and in the vicinity of the side wall 23, 24 of the cylinder head 1.

Furthermore, since the pivot installation hole 21 is formed at a position nearer to the cylinder than the branched point 4*c* of the intake port 4 of the siamese shape as shown in FIG. 4, the pivot installation hole can have a sufficient depth without decreasing the cross-sectional area of the intake port 4. The port 4 is a so-called high-port type so that intake air is guided into the combustion chamber in the generally vertical direction. In this embodiment, since the high-port type of port is used for the intake port 4, the flow resistance from the intake port into the combustion chamber becomes small so that the intake air charging efficiency of the engine is improved. Therefore, intake air is effectively compacted in the combustion chamber.

With this structure, since each swinging end of the rocker arm 2 and that of the rocker arm 3 can be disposed opposite to each other, the angle defined between the stems of the intake and exhaust valves 51, 52 can become smaller without being restricted by the length of the rocker arm 2, 3. This permits the upper surface of the combustion chamber to be made flatter, thereby contributing to the ability to set the compression ratio of the internal combustion engine at a high value. Additionally, since the distance between the intake and exhaust camshafts can be made relatively short, the lateral width of the cylinder head can be made shorter.

What is claimed is:

1. A cylinder head of an internal combustion engine, comprising:

two engine valves which are provided for each cylinder of the engine;

a rocker arm which contacts top ends of said engine valves at a first end of said rocker arm;

a pivot which contacts a second end of said rocker arm so as to swingingly support said rocker arm;

means for defining in said cylinder head a gas port through which gas passes said gas port having a first passage section which is opened to outside of said cylinder head, and second and third passage sections which are connected with said first passage section and communicable to said cylinder, said second and third passage sections being separate from each other; and means for defining a pivot installation hole which is formed between the second and third passage sections of the gas port, said pivot installation hole receiving said first pivot therein.

2. A cylinder head as claimed in claim 1, wherein said engine valves are intake valves, and said gas port is an intake port.

3. A cylinder head as claimed in claim 1, wherein a bottom of said pivot installation hole is lower in level than an upper part of an inner surface of said gas port.

4. A cylinder head as claimed in claim 1, wherein said cylinder head is secured to a cylinder block with head bolts in a manner such that each of the head bolts is screwed into the cylinder block through a head bolt hole.

5. A cylinder head as claimed in claim 1, further comprising means for defining a generally straight oil passage through which lubricating oil is supplied to sliding surfaces of camshafts and to stems of intake and exhaust valves.

6. A cylinder head as claimed in claim 1, further comprising a camshaft which is rotatably supported between a bearing section and a camshaft bracket, said camshaft bracket being fixedly secured to the bearing section with two bolts.

7. A cylinder head as claimed in claim 6, wherein said camshaft bracket has an oil passage defined by a pipe so that lubricating oil is sprayed through said oil passage and over the sliding surfaces of said camshaft and over intake and exhaust valves.

* * * * *